US010668317B2

(12) United States Patent
Wortham

(10) Patent No.: US 10,668,317 B2
(45) Date of Patent: Jun. 2, 2020

(54) RESISTIVE THERAPEUTIC DEVICE AND METHODS OF MAKING AND USING THE SAME

(71) Applicant: John Scott Wortham, Kenbridge, VA (US)

(72) Inventor: John Scott Wortham, Kenbridge, VA (US)

( * ) Notice: Subject to any disclaimer, the term of this patent is extended or adjusted under 35 U.S.C. 154(b) by 119 days.

(21) Appl. No.: 15/946,114

(22) Filed: Apr. 5, 2018

(65) Prior Publication Data

US 2019/0308059 A1 Oct. 10, 2019

(51) Int. Cl.

| | |
|---|---|
| ***A63B 21/00*** | (2006.01) |
| ***A63B 21/02*** | (2006.01) |
| ***A63B 23/10*** | (2006.01) |
| ***A63B 23/035*** | (2006.01) |
| ***A63B 23/08*** | (2006.01) |
| ***A63B 21/045*** | (2006.01) |
| ***A63B 21/04*** | (2006.01) |

(52) U.S. Cl.

CPC ..... *A63B 21/4034* (2015.10); *A63B 21/023* (2013.01); *A63B 21/045* (2013.01); *A63B 23/03508* (2013.01); *A63B 23/085* (2013.01); *A63B 23/10* (2013.01); *A63B 21/0407* (2013.01); *A63B 21/0435* (2013.01); *A63B 23/08* (2013.01)

(58) Field of Classification Search

CPC ..... A63B 21/4034; A63B 23/03508; A63B 23/085; A63B 23/10; A63B 21/023; A63B 21/045; A63B 23/08; A63B 21/0407; A63B 21/0435

See application file for complete search history.

(56) References Cited

U.S. PATENT DOCUMENTS

| | | | | |
|---|---|---|---|---|
| 1,509,793 A * | 9/1924 | Thompson | ..... | A63B 21/023 482/79 |
| 3,000,632 A * | 9/1961 | Fuchs | ..... | A63B 21/04 482/97 |
| 3,421,760 A * | 1/1969 | Freeman, Jr. | ..... | A63B 21/04 482/80 |
| 5,433,684 A * | 7/1995 | Carrillo | ..... | A63B 23/085 482/123 |
| 6,277,057 B1 * | 8/2001 | Hayden | ..... | A63B 21/0083 482/79 |

(Continued)

*Primary Examiner* — Sundhara M Ganesan

(74) *Attorney, Agent, or Firm* — NK Patent Law

(57) ABSTRACT

The presently disclosed subject matter is directed to a device that can be used to exercise and/or strengthen the muscles of the foot, ankle, and/or leg of a user. The device includes foot-receiving pedal that is sized and shaped to provide support for a user's foot or shoe. The pedal includes a first pair of brackets positioned at the rear of the pedal that allow connection to the support at a joint. The support can include a band that rests against the user's leg to provide comfort during use. The joint allows the pedal to move relative to the support. One or more resistive elements (e.g., springs) attach the support to a second pair of brackets positioned at the front portion of the pedal to provide resistance to the movement of the joint. The support includes an adapter that allows the attachment of the springs to be modified to vary resistance and/or be customized to a user's particular leg shape or length.

20 Claims, 8 Drawing Sheets

(56) References Cited

U.S. PATENT DOCUMENTS

| | | | | |
|---|---|---|---|---|
| 7,481,751 | B1 * | 1/2009 | Arnold | A63B 21/023 482/121 |
| 9,254,415 | B2 * | 2/2016 | Ha | A63B 23/03508 |
| 9,302,153 | B2 * | 4/2016 | Harwin | A63B 26/003 |
| 9,713,735 | B2 * | 7/2017 | Lanfranco | A63B 21/00 |
| 2002/0193210 | A1 * | 12/2002 | Turner | A63B 21/0552 482/80 |
| 2006/0276311 | A1 * | 12/2006 | Martin | A63B 21/00065 482/92 |
| 2013/0231227 | A1 * | 9/2013 | Ranieri | A63B 21/0421 482/124 |
| 2016/0339296 | A1 * | 11/2016 | Barel | A63B 21/0557 |
| 2017/0043211 | A1 * | 2/2017 | Mack | A63B 23/08 |
| 2018/0318639 | A1 * | 11/2018 | Kim | G06F 3/0334 |

* cited by examiner

RESISTIVE THERAPEUTIC DEVICE AND METHODS OF MAKING AND USING THE SAME

TECHNICAL FIELD

The presently disclosed subject matter relates to a therapeutic device that can be used to target and strengthen the muscles of the leg by providing spring resistance.

BACKGROUND

Resistance training is a form of exercise or therapy where physical resistance against muscle movement is used to strengthen and build muscle. Resistance training benefits overall health and is the basis of many forms of rehabilitation and athletic training. For example, resistance training is often used to rebuild atrophied muscles and restore functionality of strained or injured joints. The muscles of the pelvis and lower extremities include the quadriceps and gluteus maximus, as well as numerous other thigh, leg, ankle, and foot muscles that are used in walking, running, standing, and stability. Traditional devices focused on these muscles include the leg press and other fixed-weight devices. However, such devices typically operate on both legs at the same time and thus are unsuitable in situations where rehabilitation of one leg is desired. In addition, fixed-weight devices provide fixed resistance and are incapable of maximizing resistance across the range of motion of a user's legs. Further, fixed-weight devices commonly have limited or no resistance adjustability. It would therefore be beneficial to provide a device that overcomes the shortcomings of the prior art.

SUMMARY

In some embodiments, the presently disclosed subject matter is directed to a device for strengthening a user's leg and foot muscles. The device comprises a foot receiving pedal comprising a pair of rear brackets and a pair of front brackets. The device further includes a calf support comprising a pair of parallel braces comprising a top end and a bottom end, a band configured at the top end of the pair of braces, configured to extend at least partially about the user's leg, behind a knee, and an adaptor comprising a plurality of aligned holes configured on each brace. The bottom end of each brace pivotally attaches to a rear bracket to form a joint. The device includes a pair of springs, each spring attaching between the front brackets of the pedal and a hole of the adaptor. The springs provide variable resistance when the pedal is moved in an upward and downward direction at the joint relative to the support.

In some embodiments, the pedal includes a bottom face that comprises one or more non-skid elements. In some embodiments, the pedal comprises one or more apertures. In some embodiments, the pedal comprises one or more retaining elements to keep a user's foot from moving from the pedal.

In some embodiments, the rear brackets include one or more alignment holes. In some embodiments, each rear bracket comprises a plurality of apertures to allow a position of the joint to be adjusted.

In some embodiments, the band comprises padding and/or is substantially U-shaped.

In some embodiments, each adaptor is configured to be parallel to a corresponding brace. In some embodiments, each adaptor does not extend beyond the brace.

In some embodiments, the presently disclosed subject matter is directed to a method of strengthening a user's foot and leg muscles. The method comprises positioning a user's foot on a foot-receiving pedal of the disclosed device, raising and lowering a front portion of the user's foot by overcoming the resistance of the springs, whereby the user's foot and leg muscles are strengthened.

In some embodiments, the method further comprises releasably attaching the user's foot to the pedal prior to use.

In some embodiments, the method further comprises adjusting the attachment of the spring along the holes of the adaptor to vary resistance of the spring.

In some embodiments, the method further comprises replacing the springs with different springs to apply greater or lesser resistance.

BRIEF DESCRIPTION OF THE DRAWINGS

The previous summary and the following detailed descriptions are to be read in view of the drawings, which illustrate some (but not all) embodiments of the presently disclosed subject matter.

DETAILED DESCRIPTION

The presently disclosed subject matter is introduced with sufficient details to provide an understanding of one or more particular embodiments of broader inventive subject matters. The descriptions expound upon and exemplify features of those embodiments without limiting the inventive subject matters to the explicitly described embodiments and features. Considerations in view of these descriptions will likely give rise to additional and similar embodiments and features without departing from the scope of the presently disclosed subject matter.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a", "an", and "the" refer to "one or more" when used in the subject specification, including the claims. Thus, for example, reference to "a device" can include a plurality of such devices, and so forth. Unless otherwise indicated, all numbers expressing quantities of components, conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments +/−20%, in some embodiments +/−10%, in some embodiments +/−5%, in some embodiments +/−1%, in some embodiments +/−0.5%, and in some embodiments +/−0.1%, from the specified amount, as such variations are appropriate in the disclosed packages and methods.

The presently disclosed subject matter is directed to a device that can be used to exercise and/or strengthen the muscles of the foot, ankle, and/or leg of a user. The device can be useful in any of a wide variety of settings, such as rehabilitation, athletic training in a gymnasium, or home exercise. The device can therefore be utilized by a wide variety of users, including athletes (e.g., for injury prevention or improved performance), people recovering from foot or leg injuries, people that desire to be in good overall shape, people who suffer from low foot and/or leg muscle strength, and people that have poor balance.

Figure 1A:
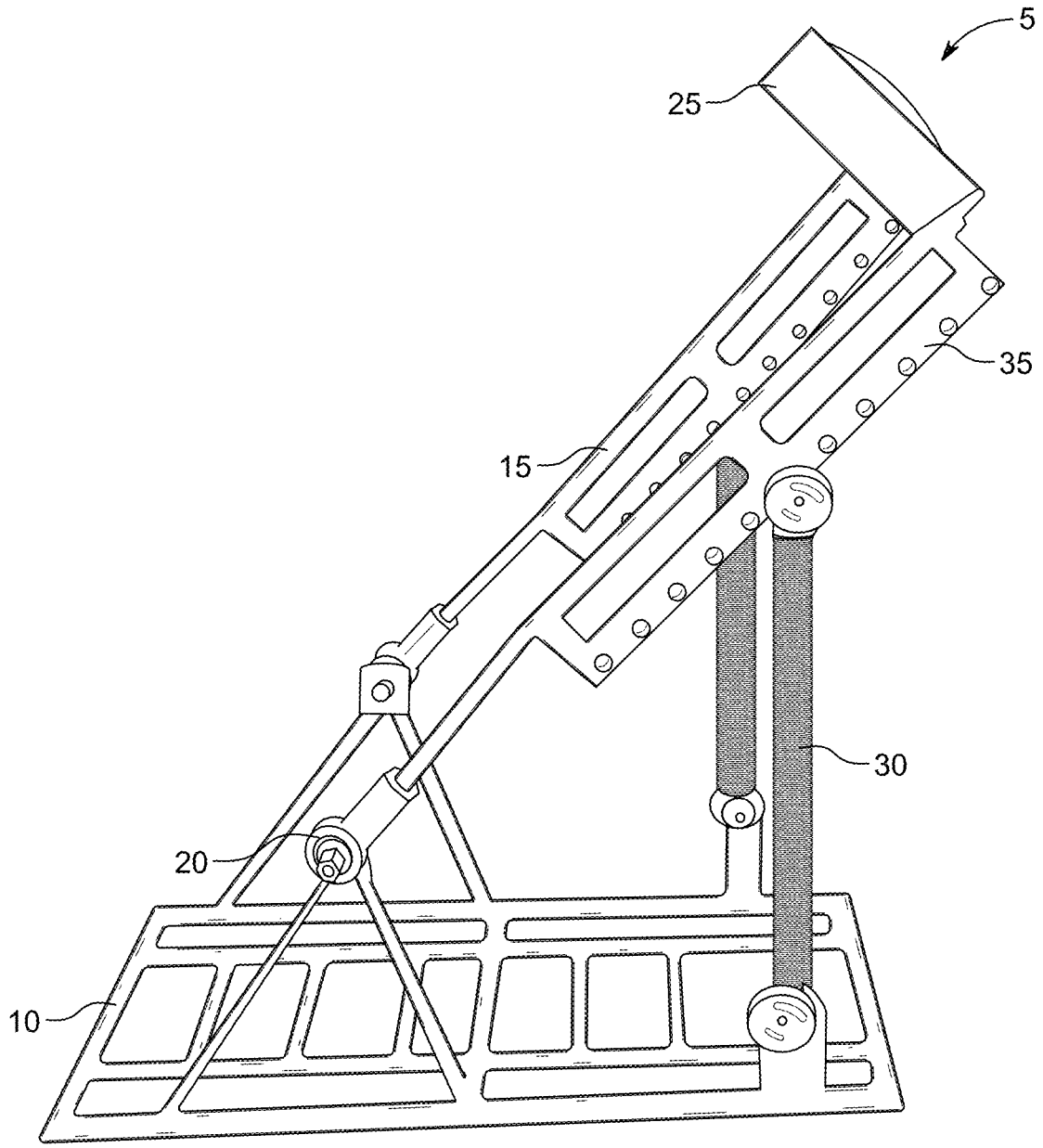
FIG. 1 a is a side plan view of a therapeutic device in accordance with some embodiments of the presently disclosed subject matter.
FIG. 1*b* is a perspective view of the device of FIG. 1*a*.
Figure 1B:
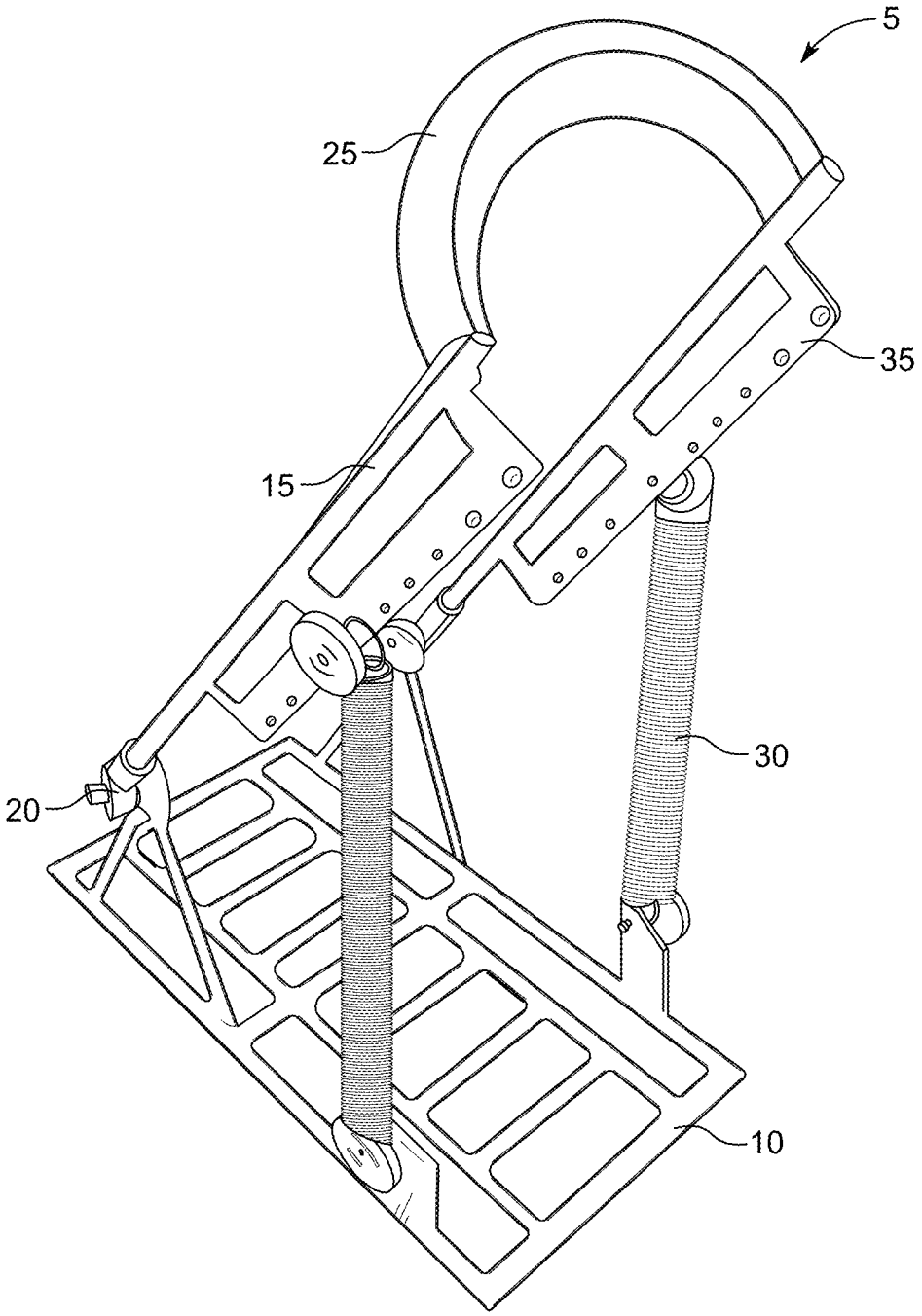

FIGS. 1*a* and 1*b* illustrate one embodiment of the disclosed exercise and rehabilitation device. Particularly, device 5 includes foot-receiving pedal 10 that is sized and shaped to provide support for a user's foot or shoe. The pedal includes a first pair of brackets positioned at the rear of the pedal that allow connection to support 15 at joint 20. As shown, the support can include band 25 that rests against the user's leg (e.g., calf or behind the user's knee) to provide comfort during use. Joint 20 allows the pedal to move relative to the support. One or more resistive elements (e.g., springs 30) attach the support to a second pair of brackets positioned at the front portion of the pedal to provide resistance to the movement of joint 20. Support 15 includes adapter 35 that allows the attachment of spring 30 to be modified to vary resistance and/or be customized to a user's particular leg shape or length.

Figure 2A:
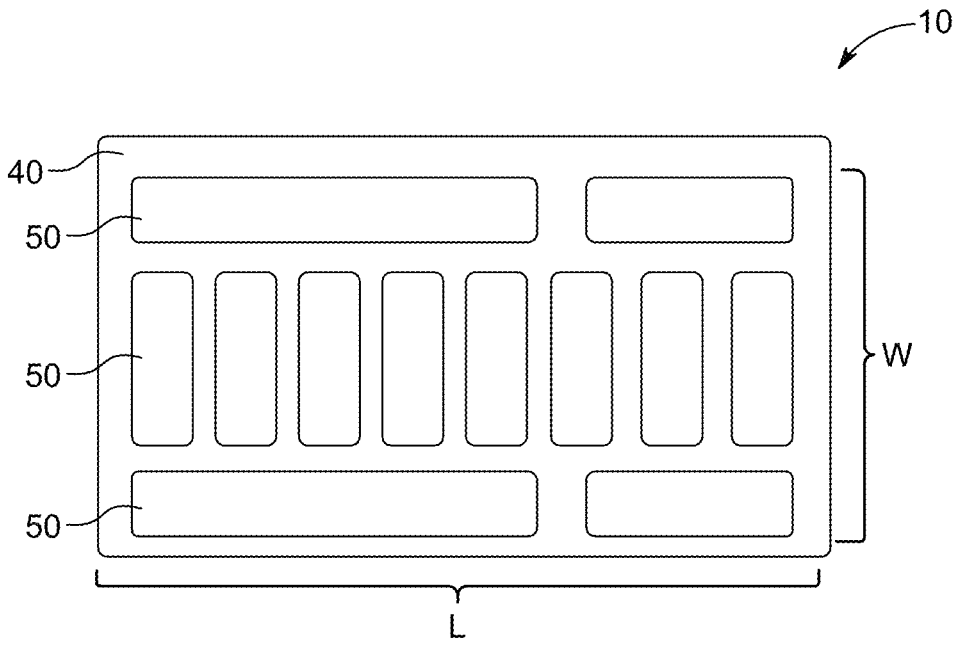
FIG. 2*a* is a top plan view of a foot-receiving pedal in accordance with some embodiments of the presently disclosed subject matter.
Figure 2B:
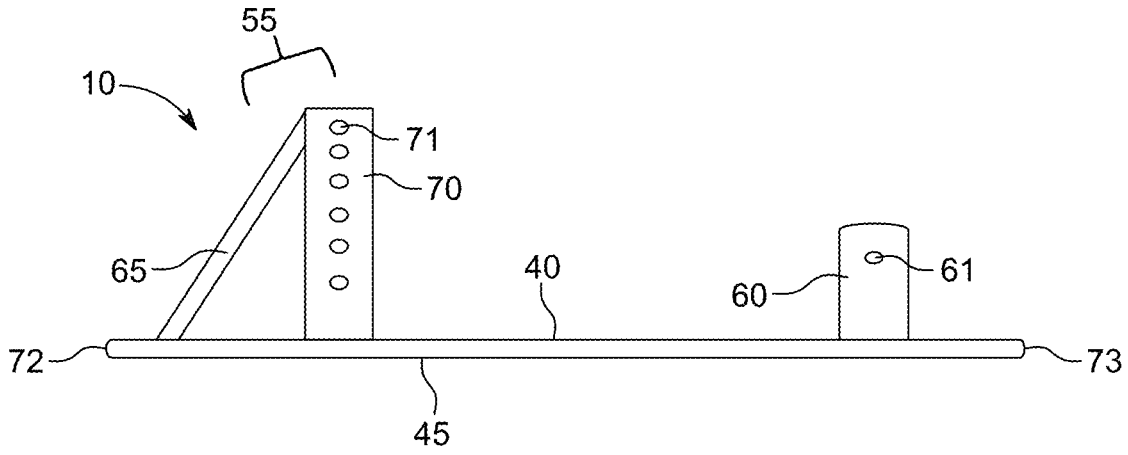
FIG. 2*b* is a side plan view of a foot-receiving pedal in accordance with some embodiments of the presently disclosed subject matter.

FIGS. 2*a* and 2*b* illustrate one embodiment of pedal 10, configured as a flat, rigid plate. Pedal 10 is sized and shaped to allow a user to position the bottom of his foot or shoe against pedal top face 40. As shown, the pedal can be rectangular in shape, although it can be configured in any desired shape (e.g., oval, square). Pedal 10 can be flat to allow the device to rest on a level surface (such as the floor), since the device is adapted to exercise the foot and/or leg. To this end, bottom face 45 of the pedal (e.g., the surface in contact with the floor) can include one or more non-skid elements to prevent unintentional movement of the device during use. For example, the non-skid elements can include rubber feet, tread, and the like.

In some embodiments, the pedal can be configured to include one or more apertures 50 to ensure that the device is lightweight and portable. However, the presently disclosed subject matter also includes embodiments wherein pedal 10 is configured as a solid plate without apertures.

Optionally, the top surface of the pedal can include a pad or other cushioning element (not shown) to contact the user's foot when in use. The pad allows for increased comfort during use of device 5. Further, in some embodiments the pad can optionally include elements to retain the user's foot during use and to prevent movement, such as straps, ties, and the like.

Figure 2C:
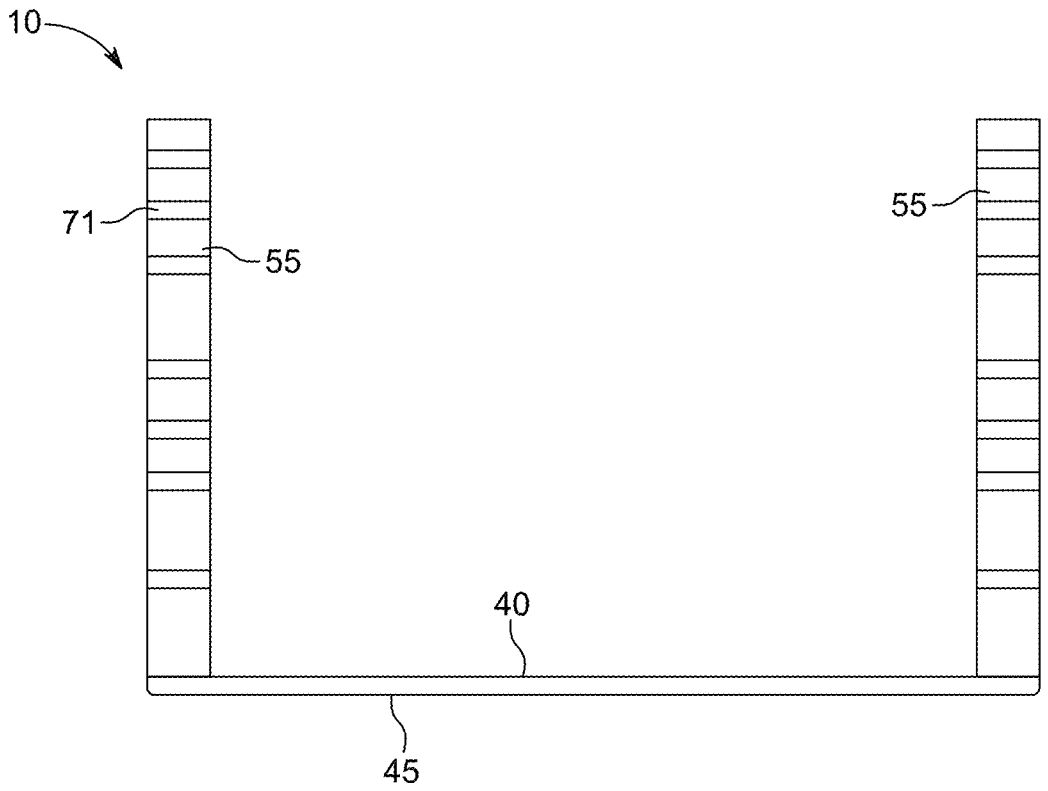
FIG. 2*c* is a rear plan view of a foot-receiving pedal in accordance with some embodiments of the presently disclosed subject matter.

As shown in FIGS. 2*b* and 2*c*, the top face of pedal 10 comprises a pair of rear brackets 55 affixed to and projecting upwards from the rear portion of the pedal. Particularly, the rear brackets can be positioned in parallel at or near the rear end 72 of the pedal (i.e., towards the "heel end" where the user's heel would be positioned in use). For example, the rear brackets can be positioned at a distance of about 5, 10, 15, 20, 25, 30, 35, or 40 percent of the total length of the pedal from pedal rear end 72. Each of the rear brackets function to connect one end of the leg support to the pedal at joint 20. While not limited to any particular design, rear brackets 55 can include one or more reinforcements 65 to provide stability. Rear brackets 55 also include body 70 that comprises one or more alignment holes 71 to adjust the height and/or position of connection to leg support 15.

In some embodiments, the rear brackets have a height of about 2, 2.5, 3, 3.5, 4, 4.5, 5, 5.5, 6, 6.5, 7, 7.5, or 8 inches. In some embodiments, the rear brackets can have a width of about 0.25, 0.5, 0.75, 1, 1.25, 1.5, 1.75, or 2 inches. However, the dimensions of rear brackets 55 are not limited and can have a height and/or width larger or smaller than disclosed above.

The top face of the pedal further comprises a pair of front brackets 60 affixed to and projecting upwards from the pedal for connecting to springs 30. As shown in FIG. 2*b*, the front brackets can include opening 61 to allow connection with springs 30, as set forth in more detail herein below. In some embodiments, the front brackets can be positioned in parallel at or near pedal front end 73 (e.g., towards the "toe end" of the pedal when the user's foot is positioned on the pedal). For example, the front brackets can be positioned at a distance of about 5, 10, 15, 20, 25, 30, 35, or 40 percent of the total length of the pedal from second end 73.

In some embodiments, the front brackets have a height of about 1, 1.5, 2, 2.5, 3, 3.5, 4, 4.5, or 5 inches. In some embodiments, the front brackets can have a width of about 0.25, 0.5, 0.75, 1, 1.25, 1.5, 1.75, or 2 inches. However, the dimensions of front brackets 60 are not limited and can have a height and/or width larger or smaller than disclosed above.

Further, although the front and rear brackets are described as being in pairs, it should be appreciated that the disclosed pedal can include embodiments with greater or lesser number of brackets. For example, the pedal can include a single front bracket, or can include 4 rear brackets.

Pedal 10 can have any desired dimensions. For example, in some embodiments the pedal can have a width (w) of about 6 inches, such as about 10, 9.5, 9, 8.5, 8, 7.5, 7, 6.5, 6, 5.5, 5, 4.5, or 4 inches. Further, in some embodiments, the pedal can have a length (L) of about 13 inches, such as about 16, 15.5, 15, 14.5, 14, 13.5, 13, 12.5, 12, 11.5, 11, 10.5, 10, 9.5, 9, 8.5, 8, 7.5, 7, 6.5, or 6 inches. However, it should be appreciated that the disclosed pedal can have a width and/or length smaller or larger than the ranges set forth herein.

The front and rear brackets can be configured as part of the pedal (e.g., constructed as a single unit). Alternatively, the brackets can be produced separately and secured to the pedal using any method known or used in the art, including (but not limited to), the use of adhesives, welding, mechanical attachments (screws, bolts, etc.), and the like.

Figure 3A:
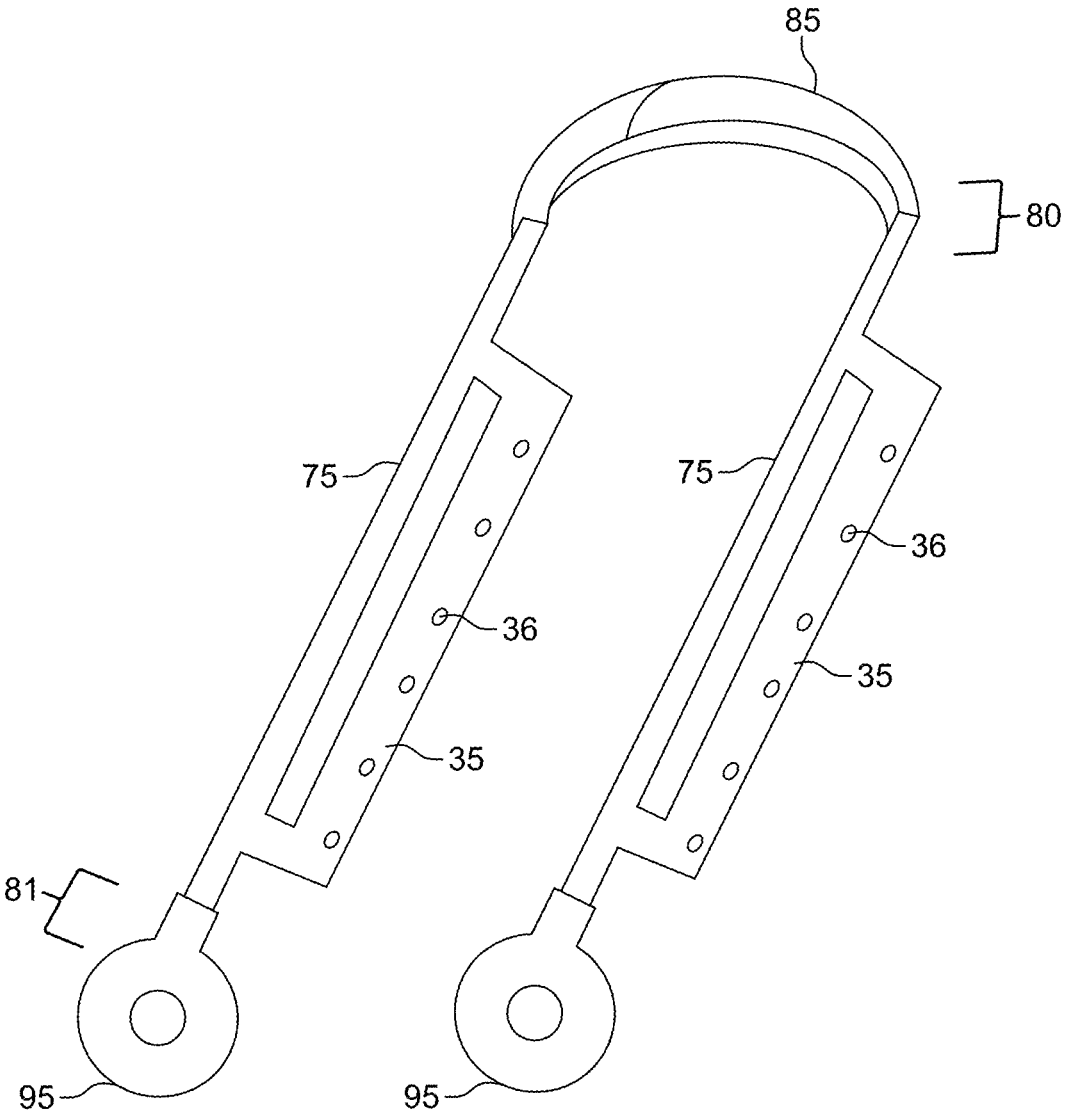
FIG. 3*a* is a perspective view of a leg support in accordance with some embodiments of the presently disclosed subject matter.

FIG. 3*a* illustrates one embodiment of leg support 15. Particularly, the support comprises first and second longitudinally extending braces 75 positioned in parallel relation to each other, joined at top end 80 by band 85 to contact the back of the user's leg (e.g., calf or knee). The braces function to support the upper portion of the user's leg (above the ankle and up to the back of the knee) while the toes of the foot are raised and lowered. As shown, band 85 is configured in a curved or generally U-shape to receive the user's leg and wrap around it. In some embodiments, the band can be padded to increase the user's comfort during use. For example, band 85 can include padding, such as (but not limited to) foam, rubber, knit, cloth, and combinations thereof.

In some embodiments, the brackets can be about 12 inches in length, such as about 8, 9, 10, 11, 12, 13, 14, 15, or 16 inches. However, it should be appreciated that the length of the brackets is not limited and can be greater or smaller than the range set forth herein.

Each brace 75 further includes adaptor 35 positioned towards top end 80, parallel or about parallel to the brace. As shown in FIGS. 3*a* and 3*c*, the adaptor includes a plurality of aligned openings 36 that are used to connect to spring 30, as discussed in more detail below. The adaptor ensures that the connection to spring 30 is adjustable to accommodate various users and/or different resistance levels. In some embodiments, the adapter has a length of about 8 inches, such as about 6, 7, 8, 9, or 10 inches. In some embodiments, openings 36 of the adaptor are spaced in 0.25 inch intervals. However, the lengths and spacing of the adaptor are not limited and can be larger or smaller than the dimensions set forth herein.

Figure 3B:
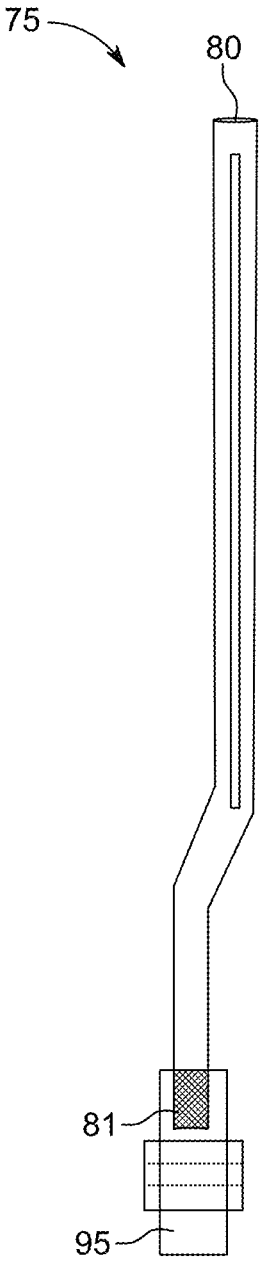
FIGS. 3*b* and 3*c* are side plan views of support braces in accordance with some embodiments of the presently disclosed subject matter.
Figure 3C:
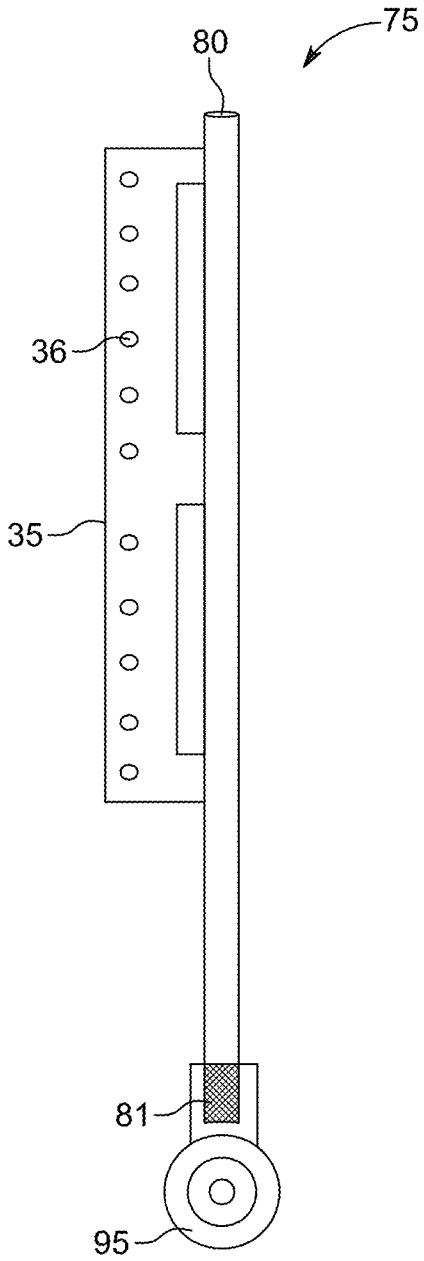

As shown in FIGS. 3*b* and 3*c*, the bottom end 81 of the braces include attachment elements 95 to connect the leg support to the rear brackets of the pedal, thereby creating a pivotable joint. The attachment element can include any known mechanism for connecting two members together at a joint. For example, a pivot pin (e.g., bolt, shoulder screw, or other securing element) can extend horizontally through an opening in the attachment element and an opening in a rear bracket. The pivot pin thus pivotally connects the pedal to the leg support. In this way, the pedal is able to rotate about the pin along an axis.

In some embodiments, attachment elements 95 are configured as part of the braces. Alternatively, the attachment elements can be configured as separate elements that are releasably or permanently attached to the bottom end of the bracket using any known mechanism (e.g., adhesive, welding, screws, bolts).

Figure 3D:
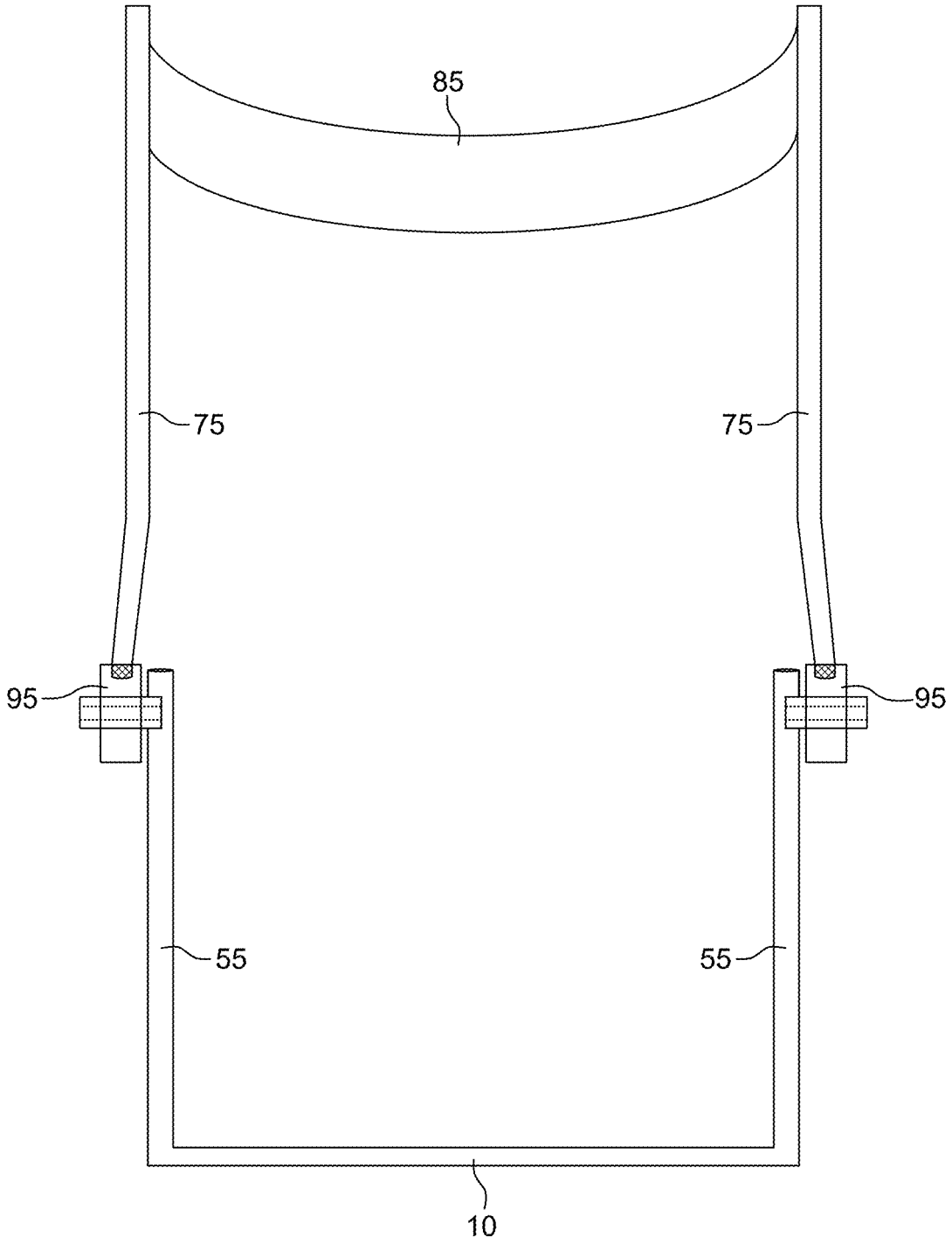
FIG. 3*d* is a front plan view of a support brace connected to a pedal bracket in accordance with some embodiments of the presently disclosed subject matter.
Figure 4A:
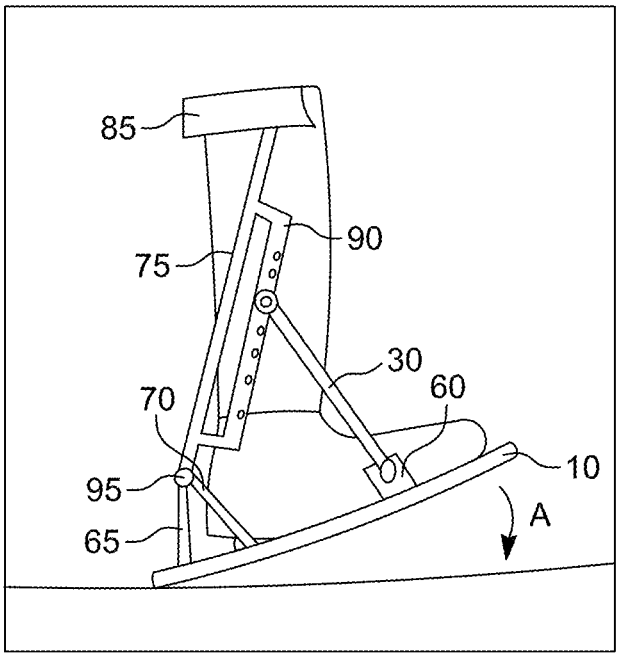
FIGS. 4*a* and 4*b* are side plan views of the therapeutic device in use in accordance with some embodiments of the presently disclosed subject matter.
Figure 4B:
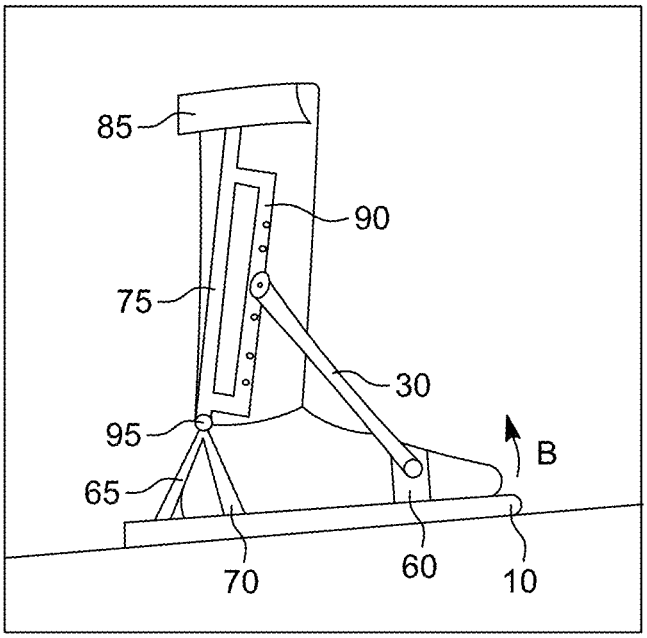

As depicted in FIG. 3*b*, in some embodiments, braces 75 can be curved or non-linear. For example, the braces can be offset in one direction by about 0.375 inches, such as about 0.2, 0.225, 0.25, 0.275, 0.3, 0.325, 0.35, 0.375, 0.4, 0.425, 0.45, 0.475, or 0.5 inches. The offsets can allow for attachment to rear brackets 55 when joint 20 is formed, as shown in FIG. 3*d*. Joint 20 permits pivoting of pedal 10 with respect to leg support 15. Specifically, as shown in FIGS. 4*a* and 4*b*, the hinge permits pivoting of pedal 10 from a raised position when the spring is tightly coiled to an extended position where the springs are elongated and the pedal rests on a support surface, such as the floor.

Pedal 10 and leg support 15 are further connected through a resistive element, that resists being stretched. In some embodiments, the resistive element can be spring 30. Alternatively, the resistive element can include one or more elastic bands, elastic tubings, or combinations thereof. The resistive element provides variable resistance that can increase or decrease as it is moved or stretched. For example, when a spring is stretched, the amount of resistance it provides can increase.

One end of the resistive element can be attached to an opening 36 of adaptor 35 using any known mechanism (e.g., screws, bolts, and the like). The other end of the resistive element is attached to front bracket 60 of the pedal using any desired mechanism, such as mechanical closures (screws, nuts, clamps, hooks, loops, pins, bolts, etc.). In some embodiments, the resistive element includes a bore at each end, such that a pin can travel through the bore and an opening in a corresponding bracket or adapter to be secured into place. Once attached at each end, the resistive element then provides resistance to the motion of the user's foot when raising or lowering the pedal.

The resistive device (e.g., spring 30) can be releasably attached to the device, allowing the user to replace the springs when they become worn, or to replace the springs with a looser or more tightly bound coil to adjust the tension of the spring as needed. The resistive element allows the tension between the pedal and the support 15 to be varied, thereby altering the exercise tension on the foot. Further, the resistive element (e.g., spring 30) can be adjusted or replaced to correspond to the strength curve of the muscles of a particular user. For example, the size and number of spring coils, and/or the thickness, rigidity, or both of the materials used to form spring 30 can be varied along the length of the spring. In this way, the spring can be configured to provide more or less resistance as it is stretched. In some embodiments, one or more fixed resistive devices (e.g., weights) can be used in addition to the one or more variable resistive devices to increase resistance, if desired.

The variability of the resistance can also be adjusted by modifying the spring attachment along the length of the adapter. The variability of the resistance is changed by adjustment along the adapter because the angle at which the spring meets the adapter is changed. At different angles, the amount of resistance the user experiences varies as the pedal is actuated. For example, at one angle, the resistance may increase more quickly as the pedal is actuated than if the spring is at another angle.

Pedal 10 is typically rotatably biased in an upward direction by spring 30, as shown in FIG. 4*a* when the user applies no pressure to the pedal. The side views of FIGS. 4*a* and 4*b* illustrate the angle formed between the inclined surface of the pedal and a horizontal surface (such as the floor). In some embodiments, the angle can have a maximum of about 10 to 60 degrees, such as about 10, 15, 20, 25, 30, 35, 40, 45, 50, 55, or 60 degrees. The tension springs provide an upward force or bias for the pedals to lift or pivot the front of the pedal for a use. The user exerts a downward pivoting force against the force or bias of the springs to exercise the muscles of the lower legs, feet, and back of the legs.

The disclosed device can be constructed from any desired rigid material known or used in the art. The term "rigid" as used herein refers to a material that is generally devoid of flexibility. For example, the pedal can be constructed from metal (e.g., stainless steel, titanium, aluminium, nickel), plastic (e.g., polyvinyl chloride), or any other rigid or substantially rigid material.

In use, the user positions his foot against the top surface of pedal 10. As mentioned above, the front end of the pedal will be raised when at rest due to the resistive forces of the coiled spring attached to front bracket 60. Optionally, straps or other fastening elements can be used to removably attach the user's foot or shoe to the top surface of the pedal. However, the fastening device is optional and the device can be used without the straps. The user can then lower the front portion of his foot (e.g., the toe end of the foot) by flexing the ankle against the resistance provided by spring to exercise the user's foot, ankle, toes, and/or the back of the user's leg. The device is then used by alternately raising and lowering the first end of the foot as shown in FIGS. 4*a* and 4*b*. Spring 30 serves as a resistance to movement of the foot, and in this way strengthens the foot, ankle, and/or leg.

Advantageously, device 5 is compact, making it suitable for home use, although it can be employed in multi-user environments, such as health clubs, gyms, physical therapy facilities, hospitals, rehabilitation centers, extended heath-care facilities, and the like. In some embodiments, the device can be utilized solely for the exercise of a single leg, without the user having to use any additional muscles during the exercise.

Training on the disclosed device generally comprises actuating the step in a downward motion. However, as part of the user's training, the user can also resist the upward motion of the step as it returns toward the unactuated position. Thus, both the upward and downward motion of pedal 10 can provide training to the user. The downward motion can utilize a different set of muscles than resisting the upward motion. As a result, different muscles can be trained as the user actuates the pedal.

To adjust the amount of variability of the resistance, the user can replace one or more springs 30 with a spring having differing amounts of resistance or differing variability of resistance. In addition, spring attachment can be moved along the length of the adapter to change the angle at which the spring meets the pedal to change the variability of the resistance experienced by the user. Thus, the user will be able to strengthen the numerous muscles within the leg, ankle, and foot by using a progressive amount of resistance provided by a number of springs.

Accordingly, the device can easily be used by a user or caregiver in clinical and home environments. The device does not require the constant attention of a caregiver. Further, the device can be used in a home environment, thereby providing a more convenient, consistent, and less expensive therapy.

As a result, the disclosed non-impact device allows the user to strengthen the numerous muscles in the lower leg, ankle, and foot by using a progressive amount of resistance provided by springs 30.

What is claimed is:

1. A device for strengthening a user's leg and foot muscles, the device comprising:
- a foot receiving pedal comprising a pair of rear brackets and a pair of front brackets;
- a calf support comprising:
  - a pair of parallel braces comprising a top end and a bottom end;
  - a band configured at the top end of the pair of braces, configured to extend at least partially about the user's leg, behind a knee;
  - an adaptor comprising a plurality of aligned holes configured on each brace;
- wherein a bottom end of each brace pivotally attaches to a rear bracket to form a joint;
- a pair of springs, each spring attaching between the front brackets of the pedal and a hole of the adaptor;
- wherein the springs provide variable resistance when the pedal is moved in an upward and downward direction about a pivot pin at the joint relative to the support, wherein the pivot pin is positioned such that the pedal pivots about an axis passing approximately through a user's ankle.

2. The device of claim 1, wherein the pedal includes a bottom face that comprises one or more non-skid elements.

3. The device of claim 1, wherein the pedal comprises one or more apertures.

4. The device of claim 1, wherein the pedal comprises one or more retaining elements to keep a user's foot from moving from the pedal.

5. The device of claim 1, wherein the rear brackets include one or more alignment holes.

6. The device of claim 1, wherein the band comprises padding.

7. The device of claim 1, wherein the band is substantially U-shaped.

8. The device of claim 1, wherein each adaptor is configured to be parallel to a corresponding brace.

9. The device of claim 1, wherein the adaptor does not extend beyond the brace.

10. The device of claim 1, wherein each rear bracket comprises a plurality of apertures to allow a position of the joint to be adjusted.

11. A method of strengthening a user's foot and leg muscles, the method comprising:
- positioning a user's foot on a foot-receiving pedal of a device comprising:
  - a foot receiving pedal comprising a pair of rear brackets and a pair of front brackets;
  - a calf support comprising:
    - a pair of parallel braces comprising a top end and a bottom end;
    - a band configured at the top end of the pair of braces, configured to extend at least partially about a user's leg, behind a knee;
    - an adaptor comprising a plurality of aligned holes configured on each brace;
  - wherein a bottom end of each brace pivotally attaches to a rear bracket to form a joint;
  - a pair of springs, each spring attaching between the front brackets of the pedal and a hole of the adaptor;
  - wherein the springs provide variable resistance when the pedal is moved in an upward and downward direction about a pivot pin at the joint relative to the support, wherein the pivot pin is positioned such that the pedal pivots about an axis passing approximately through the user's ankle;
  - raising and lowering a front portion of the user's foot by overcoming the resistance of the springs,
  - whereby the user's foot and leg muscles are strengthened.

12. The method of claim 11, further comprising releasably attaching the user's foot to the pedal prior to use.

13. The method of claim 11, further comprising adjusting the attachment of the spring along the holes of the adaptor to vary resistance of the spring.

14. The method of claim 11, further comprising replacing the springs with different springs to apply greater or lesser resistance.

15. The method of claim 11, wherein the pedal includes a bottom face that comprises one or more non-skid elements.

16. The method of claim 11, wherein the band comprises padding.

17. The method of claim 11, wherein the band is substantially U-shaped.

18. The method of claim 11, wherein each adaptor is configured to be parallel to a corresponding brace.

19. The method of claim 11, wherein the adaptor does not extend beyond the brace.

20. The method of claim 11, wherein each rear bracket comprises a plurality of apertures to allow the position of the joint to be adjusted.

* * * * *